United States Patent [19]

Durrett

[11] Patent Number: 4,497,231

[45] Date of Patent: Feb. 5, 1985

[54] FIBER CUTTER COMPONENT

[75] Inventor: Van D. Durrett, Shelby, N.C.

[73] Assignee: D. M. & E. Corporation, Shelby, N.C.

[21] Appl. No.: 465,165

[22] Filed: Feb. 9, 1983

[51] Int. Cl.[3] ..... D01G 1/04

[52] U.S. Cl. ..... 83/663; 83/347; 83/698; 83/913

[58] Field of Search ..... 83/346, 347, 913, 37, 83/665, 663, 673, 674, 698; 30/128; 242/115, 242/118.5, 118.6, 118.61, 118.62; 403/338

[56] References Cited

U.S. PATENT DOCUMENTS

| | | | |
|---|---|---|---|
| 577,069 | 2/1897 | Saiberlich | 83/673 X |
| 776,082 | 11/1904 | O'Reilly | 242/118.5 |
| 2,303,031 | 11/1942 | Dusevoir | 403/338 |
| 2,326,941 | 8/1943 | Heitner | 403/338 X |
| 3,257,885 | 6/1966 | Hornung | 83/346 |
| 3,831,481 | 8/1974 | Van Doorn | 83/913 X |

*Primary Examiner*—James M. Meister
*Attorney, Agent, or Firm*—Daniel E. McConnell

[57] ABSTRACT

A cover for a cutter reel used in a staple cutting apparatus of known type is formed by a plurality of circular segment elements joined together by fasteners to form an annular cover member encircling a cutter reel member. The annular cover member of the invention is thereby adapted for use with cutter reels having a wide variety of blade configurations.

3 Claims, 4 Drawing Figures

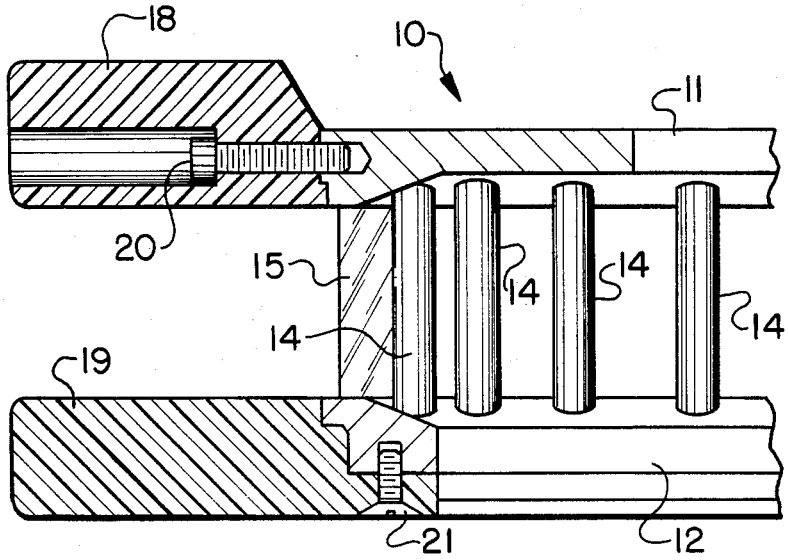
FIG. 2 PRIOR ART
FIG. 3
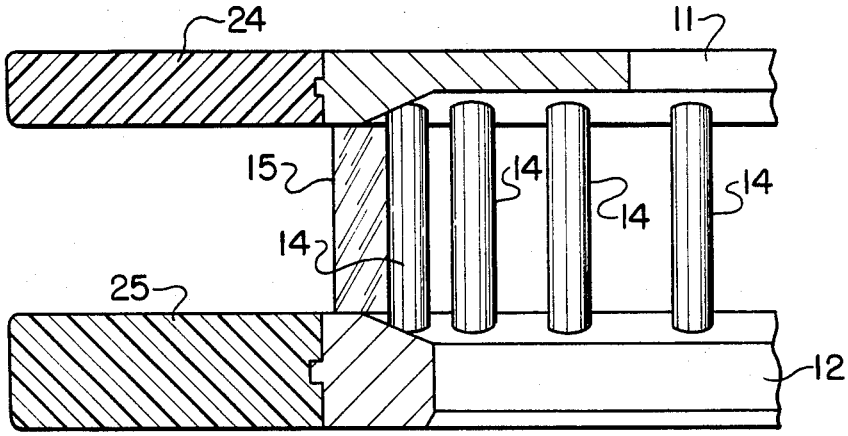

FIBER CUTTER COMPONENT

FIELD AND BACKGROUND OF INVENTION

This invention relates to fiber cutters of the type which cut continuous filament textile fiber into short lengths known as staple. Two exemplary United States Patents which relate to the field of this invention are Keith U.S. Pat. No. 3,485,120 and Van Doorn et al U.S. Pat. No. 3,831,481.

The development of apparatus of the types shown and described in the Keith and Van Doorn et al patents has included development of components intended to guide fiber into proper position and to protect the more highly machined and valuable components of the apparatus from damage which may otherwise result from the operational characteristics of the devices. More particularly, the cutter apparatus of the type described has a pair of annular reel members spaced axially one from the other to define a fiber wrapping zone therebetween and a number of radially directed cutting blades mounted axially of the annular members in a circumferential series around the reel thus formed. Components known as "covers" engage the reel members to guide filament into position for cutting. One operational problem which arises with cutter reels of this type occurs when fiber is not cut, for whatever reason including dullness of the blades, and instead accumulates around the periphery of the reel as the reel is driven in rotation about its central axis.

In an effort to solve the problem mentioned above, prior reel assemblies, including that of the Van Doorn et al patent mentioned above, sometimes are provided with press roll and cover components fabricated of materials intended to yield under the forces which arise with fiber accumulation and fail so as to protect the more expensive machined reel members and assembly. The covers referred to above take the form of annular members which are secured to the reel adjacent the fiber wrap zone, typically by a series of radial and axial bolts as shown in the Van Doorn et al patent.

Because many users of staple cutting apparatus of the types described cut staple of various lengths for various customer uses, many apparatus are used with sets of reels each configured to cut staple of a predetermined length or range of lengths. The reels are configured by selecting a spacing from blade to blade in the circumferential series, with such spacing determining the staple length or lengths cut by the reel. Such spacing also determines the acceptable or possible spacing of the radial and axial bolts for securing the cover components in place, as such bolts must be positioned to avoid unacceptable weakening of the reel assembly. As will be understood, the cover components for each reel in a set are unique, within the set, to the companion reel and are not interchangable to other reels of the set. Thus the user of such a set of reels is faced with the necessity of maintaining a large inventory of covers and of properly identifying covers to reels when replacement is needed. Additionally, the replacement of a cover may often involve the removal and reinsertion of a large number of bolts.

BRIEF DESCRIPTION OF INVENTION

With the foregoing discussion in mind, it is an object of this invention to provide cover accessories for cutter reels for staple cutting apparatus which are capable of being mounted upon and cooperating properly with reels configured to cut staple of varying lengths. In realizing this object of the present invention, the difficulties of inventory, identification and possible reel damage occurring with the reels and covers known heretofore are avoided.

Yet a further object of the present invention is to facilitate the changing of covers of the general type described. In realizing this object of the present invention, the manner in which the covers of this invention are secured in place about a reel assembly is simplified so as to reduce the number of fasteners which must be removed and replaced during the changing of a cover component.

BRIEF DESCRIPTION OF DRAWINGS

Some of the objects of the invention having been stated, other objects will appear as the description proceeds, when taken in connection with the accompanying drawings, in which:

FIG. 2 is an elevation view, partly broken away, of a reel assembly of a known type for use in an apparatus such as that schematically represented in FIG. 1;

FIG. 3 is a view similar to FIG. 2, showing a reel assembly and incorporating the improved cover accessories of the present invention.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
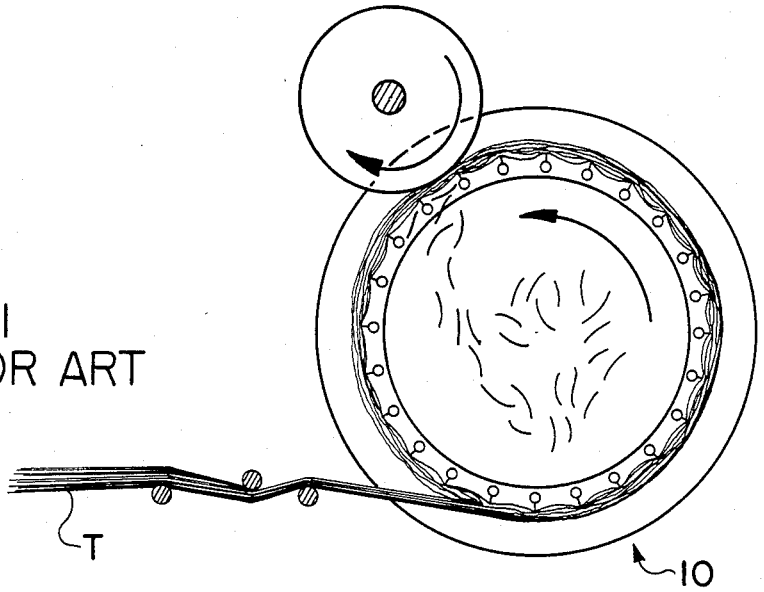
FIG. 1 PRIOR ART
FIG. 1 is a schematic plan view of a staple cutting apparatus of a known type.

Referring now more particularly to the accompanying drawings, FIGS. 1 and 2 are intended primarily to orient the reader to the staple cutting apparatus and reel assemblies known and used prior to the present subject invention. As there shown, and as described more fully in the aforementioned Keith and Van Doorn et al patents to which the interested reader is referred, a tow T of continuous filament fiber is wrapped about a reel assembly generally indicated at 10. The reel assembly has a pair of annular reel members 11, 12 which are axially spaced apart by pins 14. Blades 15 are mounted in the pins 14 and have sharpened edges directed radially for engaging and cutting the tow T. The blades 15 are engaged and retained in position by a blade retainer. The reel assembly 10 may be mounted and driven in rotation about its central axis as described in the aforementioned prior disclosures.

Cover components as described heretofore are provided by an upper annular member 18 and a lower annular member 19 (FIG. 2). The upper annular member is secured to one annular reel member 11 by radial bolts 20, while the lower annular member is secured to the other annular reel member 12 by axial bolts 21. The numbers and placement of these mounting bolts give rise to the problems and difficulties mentioned above with reference to the reel assemblies of known design. Reels of alternate designs are known in which set screws retain the cover components in position, and such "flock" reels do not overcome the problems and difficulties referred to here.

Figure 4:
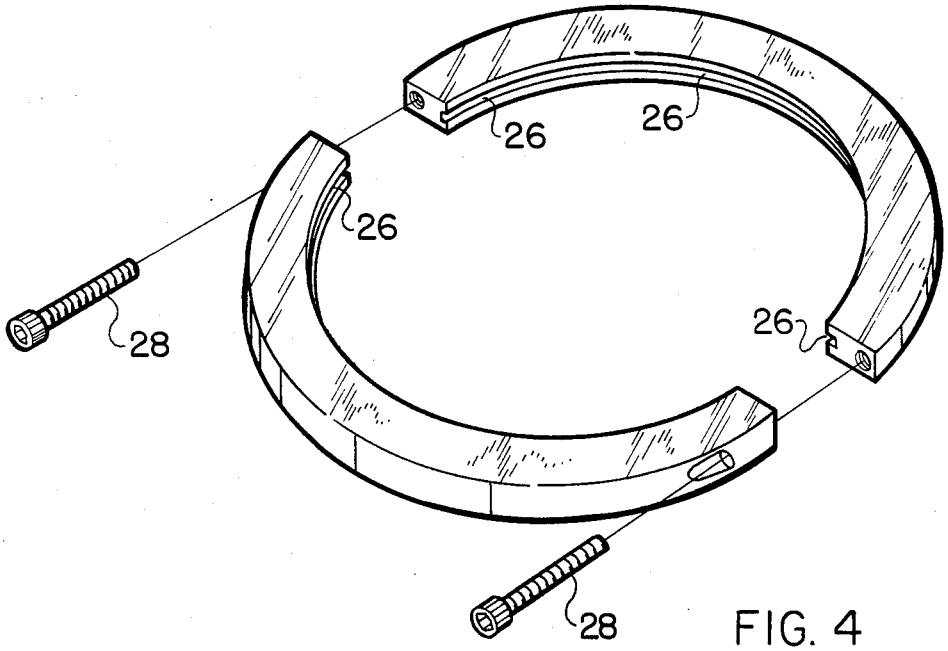
FIG. 4 is a perspective view of a cover accessory of this invention.

In order to facilitate changing cover members as may be required and to eliminate any need for maintaining an inventory of a large number of covers for a set of reels, the cover components in accordance with this invention are configured to be secured to associated annular reel members in a way which avoids the need for any radial or axial bolts as used heretofore. In particular, and as shown in FIGS. 3 and 4 where like reference characters are applied to components identified heretofore in describing the structure of FIGS. 1 and 2, the covers in accordance with this invention include an upper annular cover member 24 and a lower annular cover member 25. In the form shown, each of the cover members 24, 25 is configured as a plurality of circular segment (preferably half circular) elements, with the segments together having an inner axial face shaped to engage an outer axial face of the encircled annular reel member. The engaging axial faces are shaped to provide a mating engagement, such as a "tongue and groove" interconnection of the cover and reel members. In the form shown, the reel members 11, 12 have projecting circumferential ribs which are received within recesses 26 in the inwardly facing surfaces of the cover members 24, 25 (FIG. 3). As will be appreciated, the location of the mating rib and recess may be reversed. Persons skilled in the arts of machine design will appreciate that still other variations are possible. Similarly, by an appropriate choice of materials, the circular segment used may be an essentially circumferential element broken at only a single point for positioning about a reel member and insertion of a fastener as now will be described.

Where the cover components are formed as half circular segments, each cover is secured together about the corresponding reel member by an appropriate number (shown as a pair) of fasteners 28 extending generally tangentially of the cover elements. By use of the fasteners or bolts, the half circular segments of the covers 24, 25 are drawn into tight engagement with the outer axial faces of the reel members and secured by both frictional and rib engagement. By the provision of the cover elements being part circular segments, such assembly and dis-assembly is accomplished with ease irrespective of the blade configurations of the cutter reels being covered. While the cover elements are shown and described with particular reference to half circular forms, persons skilled in the arts to which this invention relates will appreciate that other part circular forms may be used to the same effect, such as third circle segments. Thus, cover members are provided which are useable with any of a plurality of reels which may make up a set for a particular cutter apparatus.

In the drawings and specifications there has been set forth a preferred embodiment of the invention and, although specific terms are used, the description thus given uses terminology in a generic and descriptive sense only and not for purposes of limitation.

That which is claimed is:

1. A reel assembly for use with a staple cutting apparatus and comprising a cutter reel having a pair of annular reel members spaced axially one from the other with each reel member defining an outwardly facing axial surface having a predetermined diameter and a circumferential mating engagement portion; a plurality of cutter blades mounted in said reel members for engaging and cutting fiber; a cover member encircling and affixed about one of the reel members and having at least two part circular segments each having an inwardly facing axial surface, and a plurality of fasteners for penetrating said segments tangentially to said inwardly facing axial surfaces for joining the segments together for encircling and engaging and gripping said outwardly facing axial surface of said reel member, one of said reel member and said cover member having a circumferential groove and the other of said reel member and said cover member having a circumferential projection, said inwardly facing axial surfaces being shaped to define a circumferential mating engagement portion for securing said cover member about said reel member.

2. Apparatus according to claim 1 wherein said inwardly facing axial surfaces define a circumferential recess for receiving a circumferential rib.

3. Apparatus according to claim 1 wherein said segments are half circular.

* * * * *